US009358773B2

(12) United States Patent
Guaraldi et al.

(10) Patent No.: US 9,358,773 B2
(45) Date of Patent: Jun. 7, 2016

(54) ADJUSTABLE FORM ROLL APPARATUS

(75) Inventors: Glen Alan Guaraldi, Kingston, NH (US); Warren Hess Jarrard, Farmington, NH (US)

(73) Assignee: Goss International Americas, Inc., Durham, NH (US)

( * ) Notice: Subject to any disclaimer, the term of this patent is extended or adjusted under 35 U.S.C. 154(b) by 559 days.

(21) Appl. No.: 13/593,185

(22) Filed: Aug. 23, 2012

(65) Prior Publication Data

US 2014/0053744 A1 Feb. 27, 2014

(51) Int. Cl.

| | |
|---|---|
| ***B41F 13/02*** | (2006.01) |
| ***B41F 31/30*** | (2006.01) |
| ***B41F 31/34*** | (2006.01) |
| ***B41F 31/36*** | (2006.01) |
| ***B41F 7/04*** | (2006.01) |
| ***B41F 7/12*** | (2006.01) |
| ***B41F 13/20*** | (2006.01) |

(52) U.S. Cl.

CPC . *B41F 13/02* (2013.01); *B41F 7/04* (2013.01); *B41F 7/12* (2013.01); *B41F 13/20* (2013.01); *B41F 31/301* (2013.01); *B41F 31/305* (2013.01); *B41F 31/307* (2013.01); *B41F 31/308* (2013.01); *B41F 31/34* (2013.01); *B41F 31/36* (2013.01)

(58) Field of Classification Search

CPC ..... B41F 31/301; B41F 31/34; B41F 13/008; B41F 13/44; B41F 7/04; B41F 7/12; B41F 13/02; B41F 13/20; B41F 31/36; B41F 31/305; B41F 31/307; B41F 31/308

USPC ..... 101/217, 485, 216, 247

See application file for complete search history.

(56) References Cited

U.S. PATENT DOCUMENTS 3,616,751 A * 11/1971 Mowry ..... 101/220
4,214,527 A 7/1980 Kamota (Continued)

*Primary Examiner* — Jennifer Simmons
*Assistant Examiner* — Marissa Ferguson Samreth
(74) *Attorney, Agent, or Firm* — Davidson, Davidson & Kappel, LLC

(57) ABSTRACT

An apparatus for adjustably positioning a form roll having a form roll axis against at least two different sized plate cylinders in a variable cutoff printing unit is provided. The apparatus includes a plate cylinder support for interchangeably supporting the at least two different sized plate cylinders, the plate cylinder support including a plate cylinder axis at least two different sized plate cylinder cams. The at least two different sized plate cylinder cams are interchangeably removably connectable to the plate cylinder support and include a smaller plate cylinder cam and a larger plate cylinder cam that are removably connectable to the plate cylinder support as alternatives of each other. The apparatus also includes a form roll hanger for supporting the form roll that is configured for contacting the smaller plate cylinder cam if the smaller plate cylinder cam is coupled to the plate cylinder support to set a smaller distance between the plate cylinder axis and the form roll axis. The form roll hanger is also configured for contacting the larger plate cylinder cam if the larger plate cylinder cam is coupled to the plate cylinder support to set a larger distance between the plate cylinder axis and the form roll axis. A method of adjustably positioning a form roll and a variable cutoff printing press are also provided.

12 Claims, 11 Drawing Sheets

(56) References Cited

U.S. PATENT DOCUMENTS

| | | | | | |
|---|---|---|---|---|---|
| 4,458,591 | A | | 7/1984 | Guaraldi | |
| 5,813,336 | A | * | 9/1998 | Guaraldi | B41F 13/20 101/218 |
| 5,868,071 | A | * | 2/1999 | Niemiro | B41F 13/30 101/218 |
| 5,950,536 | A | * | 9/1999 | Erbstein | B41F 7/12 101/177 |
| 5,950,539 | A | * | 9/1999 | Manzini | 101/217 |
| 6,041,706 | A | * | 3/2000 | Murray | B41F 13/44 101/185 |
| 6,109,181 | A | | 8/2000 | Kamoda | |
| 7,270,057 | B2 | | 9/2007 | Motard | |
| 2012/0012017 | A1 | * | 1/2012 | Zlatin | B41F 13/44 101/217 |
| 2012/0174807 | A1 | | 7/2012 | Zlatin | |

* cited by examiner

ADJUSTABLE FORM ROLL APPARATUS

The present invention relates generally to printing presses and more specifically to an adjustable form roll apparatus of a printing press.

BACKGROUND

U.S. Pat. No. 4,458,591 purportedly discloses a printing press having a plate cylinder throw off means including means for disengagement of a plate cylinder from a blanket cylinder without skew movement of the plate cylinder. A form roll-plate cylinder adjustment means is also provided for adjusting the center-to-center distance between the form roll and the plate cylinder. A cam has surface means for maintaining the center-to-center distance between the form roll and the plate cylinder as the plate cylinder is thrown off the blanket cylinder and as the skew adjusting means varies the angle between the blanket and plate cylinders.

U.S. Pat. No. 7,270,057 purportedly discloses an adjustment system for positioning a rolling element such as a form roller or an impression cylinder relative to a first cylinder having a first diameter and relative to at least a second cylinder adapted to replace the first cylinder and having a second diameter different than the first diameter.

Commonly owned U.S. Patent Publication No. 2012/0174807 discloses an adjustable dampening apparatus including a rotatable base for supporting a dampening roller, a rotatable socket connected to the rotatable base for adjusting a position of the dampening roller, a first actuating device connected to the rotatable base for positioning the rotatable base in a predetermined position for a given cutoff and a second actuating device connected to the rotatable socket for positioning the rotatable socket between a first position and a second position.

SUMMARY OF THE INVENTION

An apparatus for adjustably positioning a form roll having a form roll axis against at least two different sized plate cylinders in a variable cutoff printing unit is provided. The apparatus includes a plate cylinder support for interchangeably supporting the at least two different sized plate cylinders, the plate cylinder support including a plate cylinder axis. At least two different sized plate cylinder cams are interchangeably removably connectable to the plate cylinder support and include a smaller plate cylinder cam and a larger plate cylinder cam that are removably connectable to the plate cylinder support as alternatives of each other. The apparatus also includes a form roll hanger for supporting the form roll that is configured for contacting the smaller plate cylinder cam if the smaller plate cylinder cam is coupled to the plate cylinder support to set a smaller distance between the plate cylinder axis and the form roll axis. The form roll hanger is also configured for contacting the larger plate cylinder cam if the larger plate cylinder cam is coupled to the plate cylinder support to set a larger distance between the plate cylinder axis and the form roll axis.

A method of adjustably positioning a form roll having a form roll axis against at least two different sized plate cylinders in a variable cutoff printing unit is also provided. The form roll is supported by a form roll hanger. The method includes placing a first plate cylinder cam of a first cam size and first plate cylinder of a first cylinder size on a plate cylinder support; contacting the first plate cylinder cam with the form roll hanger, the contacting of the first plate cylinder cam with the form roll hanger causing the form roll to enter into a loaded position with the first plate cylinder; removing the first plate cylinder cam and the first plate cylinder from plate cylinder support; placing a second plate cylinder cam of a second cam size and second plate cylinder of a second cylinder size on the plate cylinder support; and contacting the second plate cylinder cam with the form roll hanger, the contacting of the second plate cylinder cam with the form roll hanger causing the form roll to enter into a loaded position with the second plate cylinder.

A variable cutoff printing unit is also provided. The variable cutoff printing unit includes a plate cylinder support including a plate cylinder axis. The plate cylinder support is configured for removably supporting a plate cylinder. The variable cutoff printing unit also includes a plate cylinder cam supported on the plate cylinder support, a form roll for transferring printing fluid to the plate cylinder supported on the plate cylinder assembly; and a form roll hanger supporting an axial end of the form roll and contacting the plate cylinder cam supported on the plate cylinder support to adjustably position the form roll against the plate cylinder supported on the plate cylinder assembly. The form roll hanger includes a surface for contacting the plate cylinder cam. The adjustment assembly is movable along a predefined path to vary a distance between a plate cylinder axis and a form roll axis.

BRIEF DESCRIPTION OF THE DRAWINGS

The present invention is described below by reference to the following drawings, in which.

DETAILED DESCRIPTION

A plate cylinder of a variable cutoff printing press typically varies from 1× to 2× in size during a cutoff change. It is advantageous if form rolls of the printing press are able to accommodate this large of a change in plate cylinder diameter without the need to be reset. Embodiments of the present invention advantageously accommodate such changes by using replaceable cams on a plate cylinder support and an articulated adjustable form roller hanger, allowing the form rolls to be quickly and easily adapted to a new size while maintaining proper distance between the form rolls and the plate cylinder for good ink transfer. In these embodiments, a centerline of the plate cylinder does not change position during the size change. Embodiments of the invention may also be used for easily adapting a printing press that does move the centerline of the plate cylinder, by retrofitting the printing press so that the centerline of the plate cylinder does not change. Similarly, in preferred embodiments of the present invention, the plate cylinder does not throw-off from a corresponding blanket cylinder when going off impression.

Figure 1:
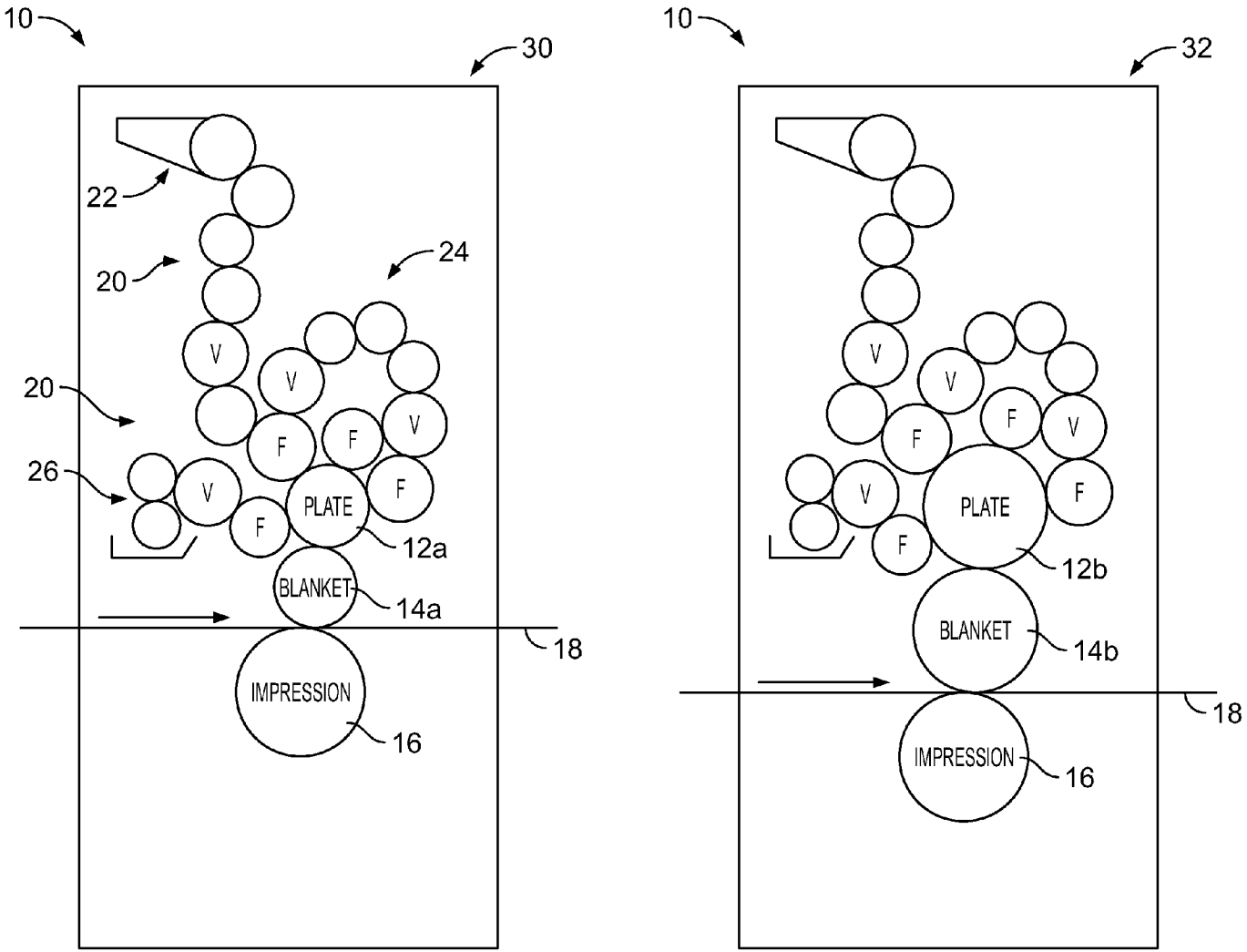
FIG. 1 shows a variable cutoff printing unit of a variable cutoff printing press according to an embodiment of the present invention in two different cutoff configurations.

FIG. 1 shows two different repeat sizes or cutoff lengths in a variable cutoff printing unit 10 of a variable cutoff printing press, which may include a plurality of variable cutoff printing units 10 according to an embodiment of the present invention. Variable cutoff printing presses are able to print a plurality of print jobs having a variety of cutoff lengths. In order to accommodate a variety of cutoff lengths, circumferences of plate and blanket cylinders may be varied, for example, blanket and plate cylinders of different sizes may be employed, existing cylinders may be packed or padded to increase their circumference, differently sized sleeves on a fixed size mandrel may be used, or printing plates and blankets having a variety of thicknesses may be interchanged. Printing unit 10 is a non-perfecting printing unit and includes a plate cylinder 12*a* or 12*b*, a blanket cylinder 14*a* or 14*b* and an impression cylinder 16, cooperating to print on one side of a web 18 passing between impression cylinder 16 and blanket cylinder 14*a* or 14*b*. In other embodiments, printing unit 10 may be a perfecting printing unit, with a second plate cylinder and a second blanket cylinder in place of impression cylinder 16 and printing unit 10 printing on both sides of web 18. Printing unit 10 further includes an inker and dampener unit 20, including an ink fountain 22, a plurality of ink rolls 24 transferring ink from ink fountain 22 to plate cylinder 12 and dampener rolls 26 transferring dampening solution to plate cylinder 12. Ink rolls 24 and dampener rolls 26 includes vibrator rolls V, which are fixed in a frame of printing unit 10 such that vibrator rolls V are not repositioned during cutoff changes but oscillate axially during printing, and form rolls F, which are circumferentially movable during cutoff changes to maintain proper contact for every size of plate cylinder 12.

In this embodiment, a plate cylinder center axis $CL_P$ remains fixed as a printing unit 10 is changed from a first cutoff length configuration 30, as shown on the left in FIG. 1, to a second cutoff length configuration 32, as shown on the right in FIG. 1, and vice versa. In the first configuration 30, cylinders 12*a* and 14*a*, 16 have an outer circumference of for example sixteen inches and in the second configuration 32, cylinders 12*b* and 14*b* have an outer circumference of for example twenty-four inches. As is apparent from FIG. 1, in order for plate cylinder 12*a* to be changed from the first configuration 30 to plate cylinder 12*b* in the second configuration 32, form rolls F are moved radially away from plate cylinder center axis $CL_P$ of plate cylinder 12. In order for plate cylinder 12*b* to be changed from the second configuration 32 to plate cylinder 12*a* in the first configuration 30, form rolls F are moved radially toward plate cylinder center axis $CL_P$.

Figure 2:
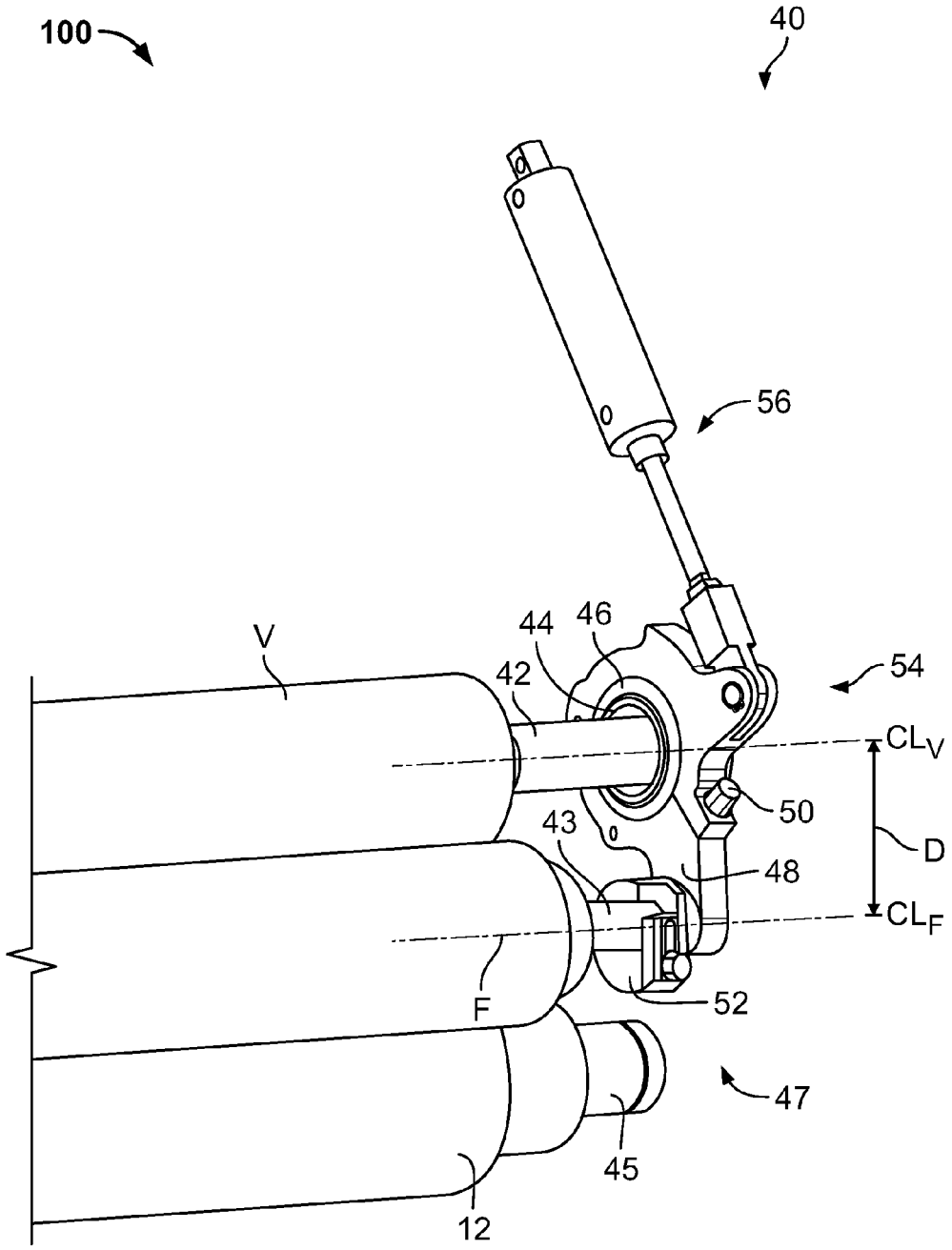
FIG. 2 shows a form roll adjusting apparatus for adjustably positioning a form roll against at least two different sized plate cylinders in the variable cutoff printing unit.

FIG. 2 shows a form roll adjusting apparatus 100 for adjustably positioning a form roll F against at least two different sized plate cylinders in a variable cutoff printing unit according to an embodiment of the present invention. Adjusting apparatus 100 includes a form roll hanger 40, which includes a hanger lever assembly 54 and an actuator 56, a plate cylinder support 47 and at least two different sized plate cylinder cams 60, 60*b*, 60*c* (FIGS. 6 to 8) that are interchangeably removably connectable to plate cylinder support 47. Lever assembly 54, in this embodiment, includes form roll F, vibrator roll V, an eccentric 46, a form roll lever 48, a bolt 50 and a roll holder 52. A shaft 42 of vibrator roll V is surrounded by a vibrator bushing 44 and eccentric 46, which surrounds vibrator bushing 44. Eccentric 46 is mounted inside of a form roll lever 48 and rotatable within form roll lever 48 to set a distance D between a center axis $CL_V$ of vibrator roll V and a center axis $CL_F$ of form roll F. Once distance D is adjusted to the desired amount, a bolt 50 inserted into a hole in form roll lever 48 is tightened to secure eccentric 46 in place to set distance D. The clamping of bolt 50 allows form roll F to be rotated about vibrator bushing 44 while maintaining distance D. Roll holder 52 is connected to form roll lever 48 and rotatably mounts a form roll F, via a shaft 43, on form roll lever 48. The mounting of roll holder 52 in form roll lever 48 allows roll holder 52 to rotate without affecting the setting between form roll F and vibrator roll V. Actuator 56, which in a preferred embodiment is a pneumatic actuator, but may in other embodiments may be for example a hydraulic, mechanical or electromechanical actuator, is tangentially connected to an outer edge of form roll lever 48 and acts to rotate lever assembly 54 around vibrator bushing 44 towards or away from plate cylinder 12 and a plate cylinder shaft 45.

Figure 3:
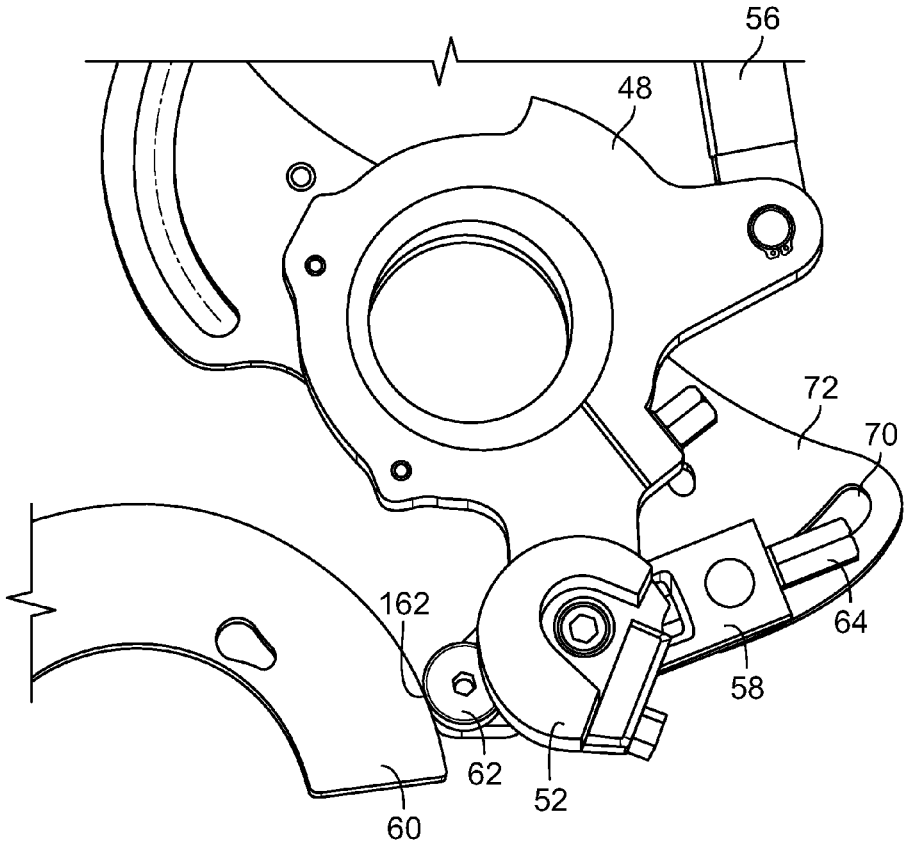
FIG. 3 shows a more detailed view of a form roll hanger of the form roll adjusting apparatus.

FIG. 3 shows a more detailed view of form roll hanger 40 with form roll F and vibrator roll V omitted for clarity. As shown in FIG. 3, an adjustment assembly 58 is coupled to roll holder 52 and form roll lever 48 on a side of hanger 40 opposite roll holder 52. Adjustment assembly 58 is rotatably mounted at a pivot pin 66 (FIG. 4) on form roll lever 48. In this embodiment, pivot pin 66 of adjustment assembly 58 is coincident with center axis $CL_F$ of form roll F (FIG. 2). A plate cylinder cam 60 is coupled to plate cylinder shaft 45 (FIG. 2) for guiding a cam follower 62 on an end of adjustment assembly 58. Adjustment assembly 58 includes a contact surface 162 on cam follower 62 for contacting plate cylinder cam 60. In order to vary the distance between center axis $CL_F$ of form roll F and center axis $CL_P$ of plate cylinder 12 (FIG. 1), cam follower 62 may be adjusted by an adjustor 64 of adjustment assembly 58. In this embodiment, adjustor 64 is a screw. Actuator 56 provides the force to maintain contact between contact surface 162 and plate cylinder cam 60.

Figure 4:
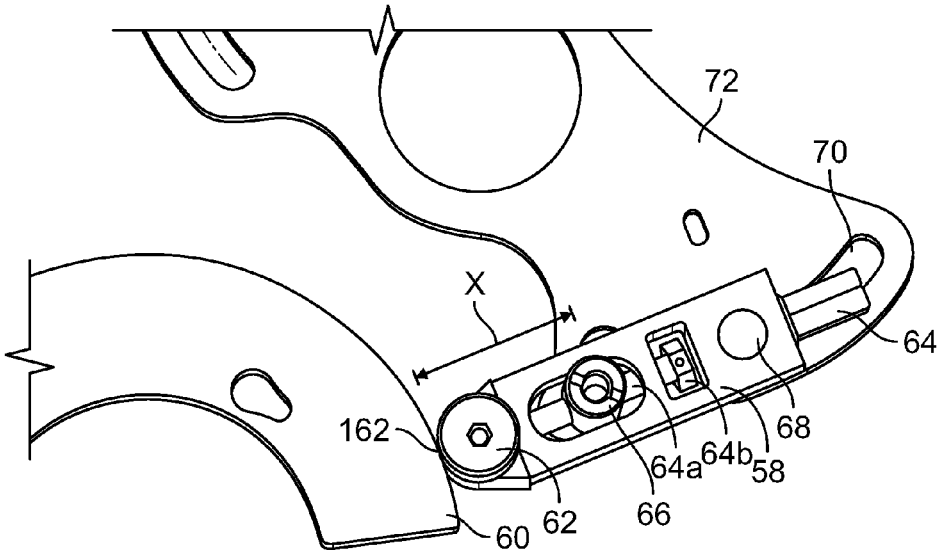
FIGS. 4 and 5 show views of further details of the form roll hanger.
Figure 5:
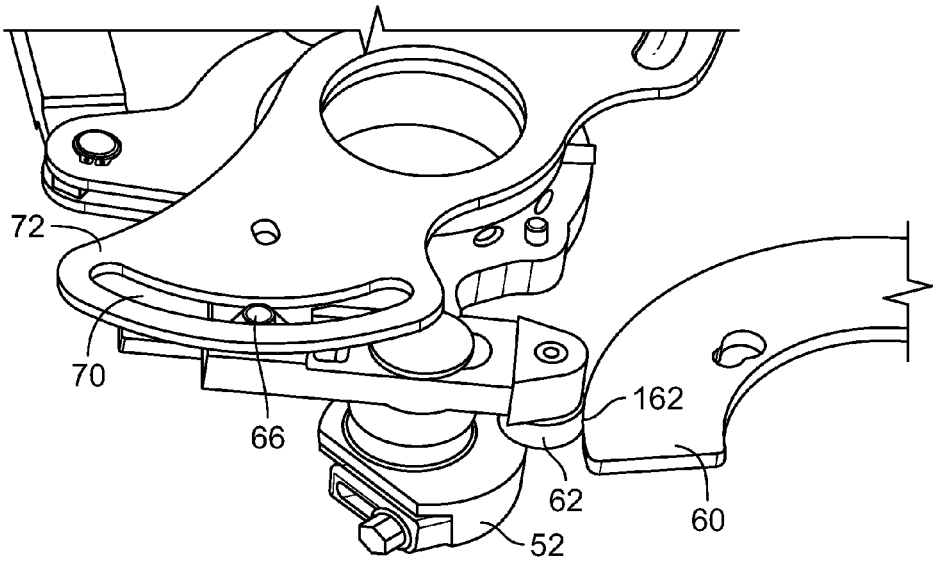

FIGS. 4 and 5 show views of further details of form roll hanger 40, with certain features omitted for clarity. Adjustor 64 includes a threaded portion 64*a* and a shoulder 64*b*. Threaded portion 64*a* is threaded into a threaded hole in adjustment assembly 58 into a threaded hole in pivot pin 66 such that rotation of adjustor 64 changes a distance X between a center of pivot pin 66 and contacting surface 162 of cam follower 62. Pivot pin 66 is mounted in and free to rotate in form roll lever 48 (FIGS. 2 and 3). Adjustment assembly 58 further includes a guide portion 68, which in this embodiment is in the form of a pin, extending into a slot 70 in a guide 72, e.g., a cam, fixed to the frame of printing unit 10 (FIG. 1). In this embodiment, cam follower 62 is rotatably mounted on adjustment assembly 58. In alternative embodiments, in place of rotatably mounted cam follower 62, a non-rotatable surface may be used for contacting plate cylinder cam 60. For example, the non-rotatable surface may be flat, concave or convex and function adequately. Of the components shown in FIG. 5, guide 72 is the furthest outward in the axial direction with respect to an axial center of the printing unit, followed by adjustment assembly 58, then form roll lever 48 and form roll holder 52.

Figure 6:
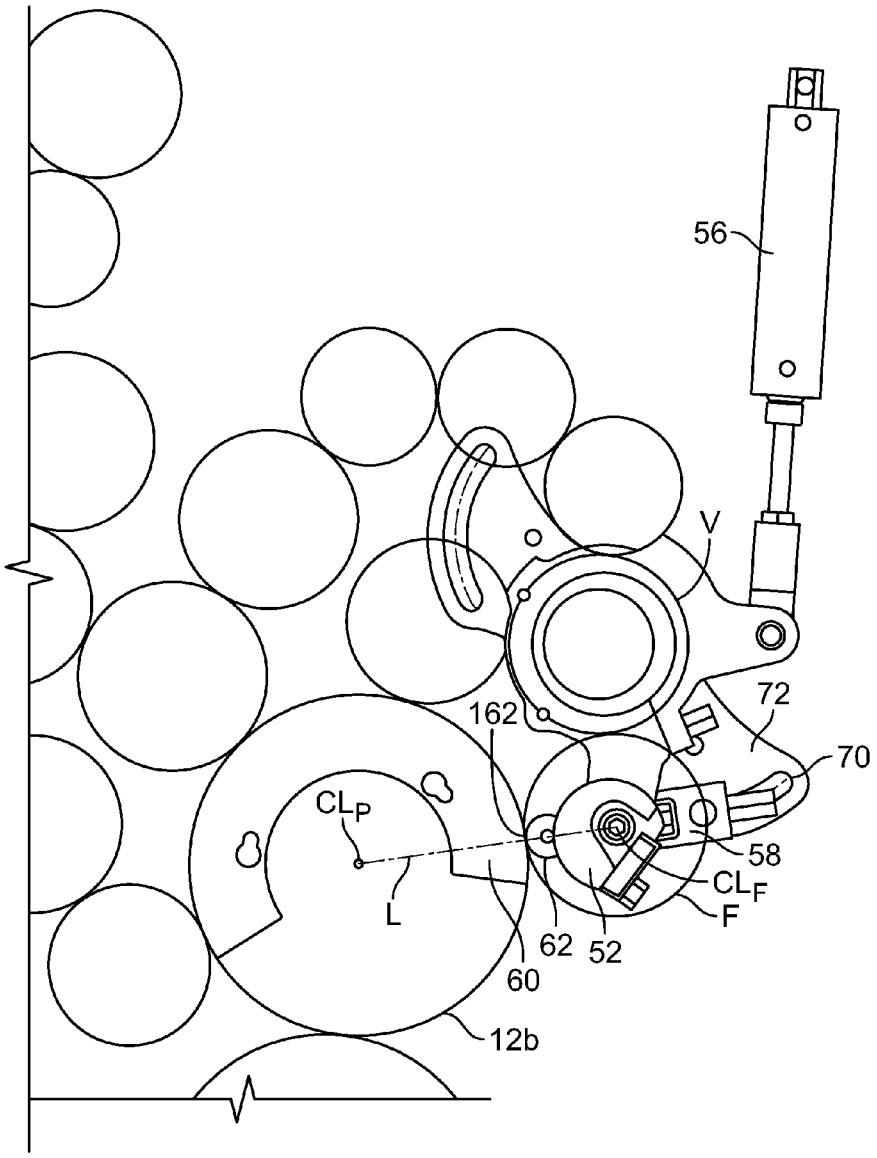
FIGS. 6, 7 and 8 show plan views of the interaction between the form roll hanger, a form roll, a vibrator roll V and three different sized plate cylinders.
Figure 7:
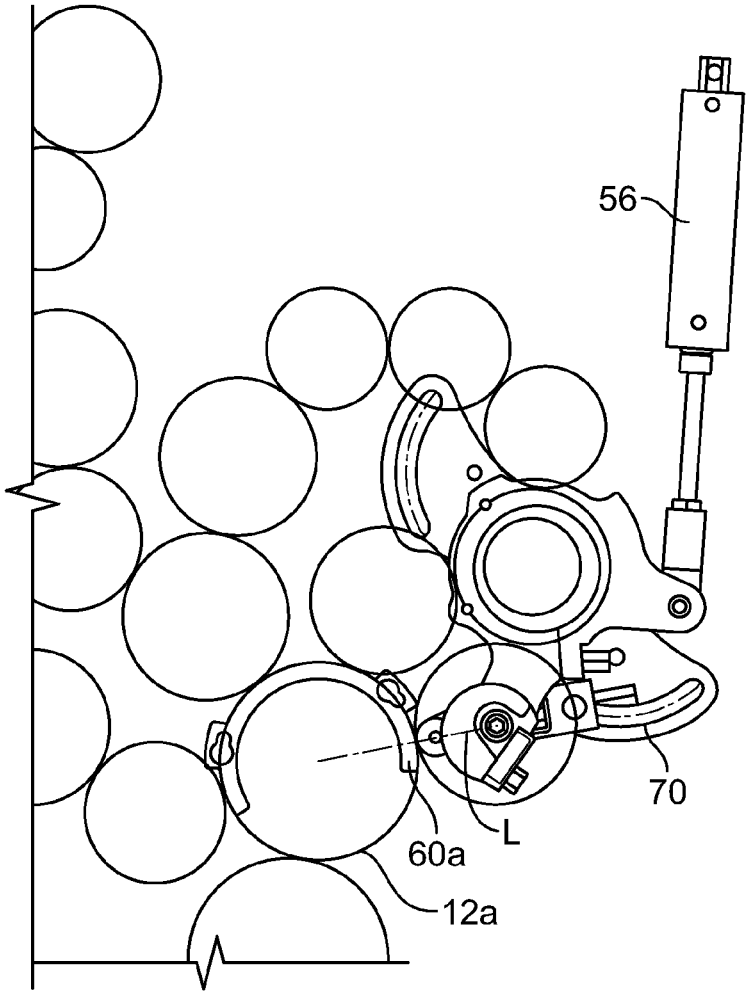

FIG. 6 shows a plan view of the interaction between form roll hanger 40, form roll F, vibrator roll V and middle size plate cylinder 12*b*. In this embodiment, an outer circumference of a middle plate cylinder cam 60*b* is concentric with and the same or similar to an outer circumference of plate cylinder 12*b*. Similarly FIG. 7 shows an effective outer diameter of plate cylinder cam 60*a* is the same or similar to an outer diameter of plate cylinder 12*a*. Plate cylinder cam 60*a* is preferably mounted with respect to plate cylinder 12*a* (and plate cylinder support 47 shown in FIG. 11) such that if the plate cylinder center axis $CL_P$ moves, plate cylinder cam 60*a* remains concentric with plate cylinder center axis $CL_P$. Accordingly, in this embodiment, if plate cylinder 12*a* is removed and replaced with a plate cylinder having a larger diameter, e.g., larger plate cylinder 12*c* shown in FIG. 8, larger plate cylinder 12*c* includes a larger plate cylinder cam 60*c* that has the same effective outer diameter as the outer diameter of larger plate cylinder 12*c* and is concentric with plate cylinder center axis $CL_P$. Center axis $CL_P$ may change for plate skewing or throw-off.

In FIG. 6, cam 60 is shown for a middle size repeat for variable cutoff printing unit 10. Cam follower 62 is set by adjustment assembly 58 so that when loaded by actuator 56, a proper squeeze between form roll F and plate cylinder 12*b* is attained. A center of cam follower 62 is located on a line L between plate cylinder center axis $CL_P$ and center axis $CL_F$ of form roll F. This alignment is accomplished by guide portion 68 being positioned in slot 70 of guide 72.

Figure 8:
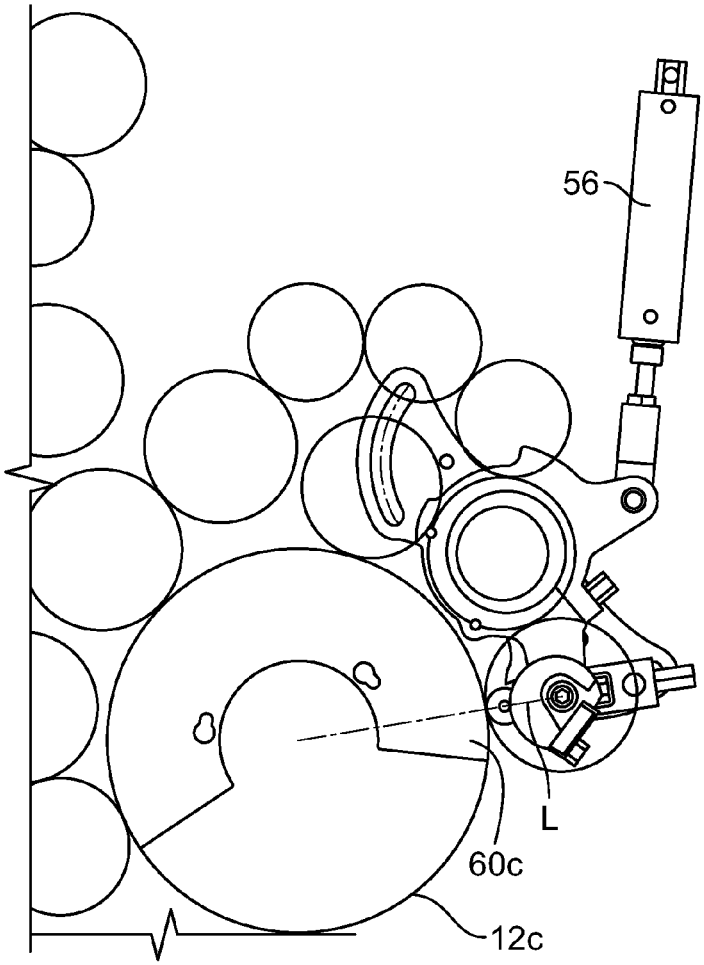

FIGS. 7 and 8 show plan views of plate cylinder cams 60*a*, 60*c* for two cutoff lengths, smaller and larger than plate cylinder 12*b*, respectively. For example as discussed above plate cylinder 12*a* has a cutoff length of sixteen inches and for example plate cylinder 12*c* has a cutoff length of thirty-two inches. Plate cylinder cams 60*a*, 60*c* are unique to each size of plate cylinders 12*a*, 12*c*, respectively, and in this embodiment have effective outer diameters equal to the outer diameters of corresponding plate cylinders 12*a*, 12*c*. Slot 70 is formed in guide 72 such that guide 72 defines a predefined path for form roll hanger 40 and slot 70 of guide 72, through interaction with guide portion 68 of form roll hanger 40, maintains the position of contact surface 162 of cam follower 62 on centerline L. The predefined path allows form roll F to maintain appropriate contact with vibrator roll V and a plurality of sized plate cylinders. In alternative embodiments, form roller F may be sized slightly different such that contact surface 162 of cam follower 62 is not exactly maintained on centerline L and still functions properly. In another embodiment, the cams can be larger or smaller than an outer circumference of plate cylinder as long as the offset is similar.

Figure 9:
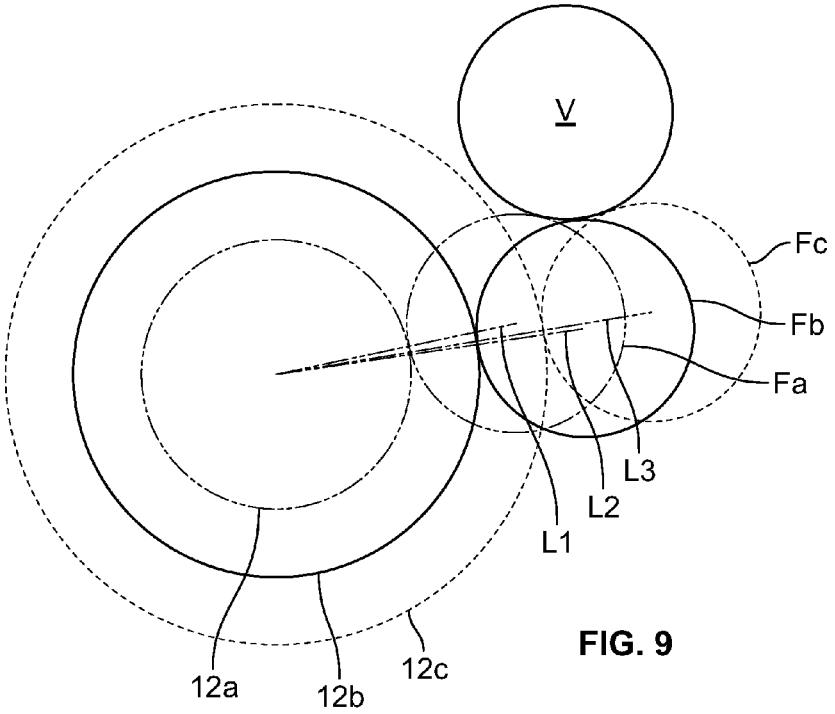
FIG. 9 shows the positioning of the form roll according to the three examples of different sized of plate cylinders.

FIG. 9 shows the positioning of form roll F according to three different sizes of plate cylinders. First, with respect to plate cylinder 12*a* of smallest diameter, form roll F is rotated into a position Fa the furthest clockwise with respect to vibrator roll V. Next, with respect to plate cylinder 12*b* of a middle diameter, form roll F is positioned into a position Fb further counterclockwise with respect to vibrator roll V. Lastly, with respect to a plate cylinder 12*c* of largest diameter, form roll F is positioned into a position Fc further counterclockwise with respect to vibrator roll V. As form roll F is repositioned for each plate cylinder 12*a*, 12*b*, 12*c* lines L1, L2, L3 between plate cylinder center axis $CL_P$ and form roll center axis $CL_F$ also move.

Figure 10:
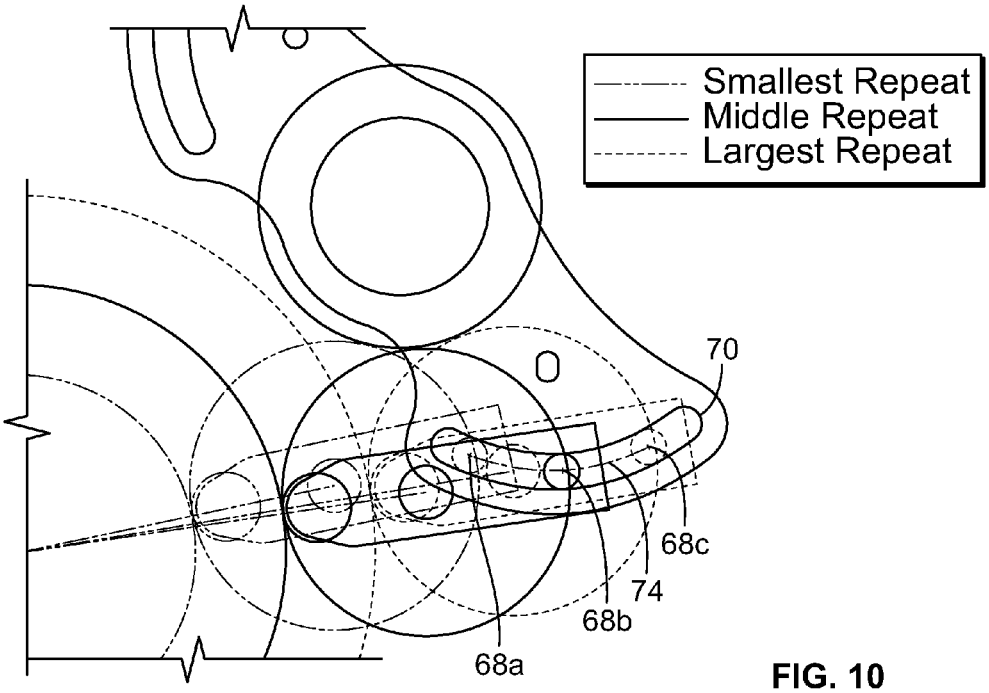
FIG. 10 shows an embodiment of a guide slot setting a predefined path of the for the form roller hanger.

FIG. 10 shows the configuration and shape of the curve of guide slot 70 according to one embodiment of the present invention. In this example, an arc 74 includes three positions 68*a*, 68*b*, 68*c* for guide portion 68 for the three different sized plate cylinders 12*a*, 12*b*, 12*c* shown in FIG. 9 (and their respective cams 60*a*, 60*b*, 60*c*) that defines the shape of guide slot 70 and establishes the predefined path of hanger 40. Position 68*a* of the predefined path for guide portion 68 corresponds to small plate cylinder 12*a*, position 68*b* of the predefined path for guide portion 68 corresponds to the middle plate cylinder 12*b* and position 68*c* of the predefined path for guide portion 68 corresponds to the large plate cylinder 12*c*. The shape of guide slot 70 may also be accurately determined to establish the predefined path of hanger 40 by fitting a polynomial or similar mathematical curve through more than three positions.

Figure 11:
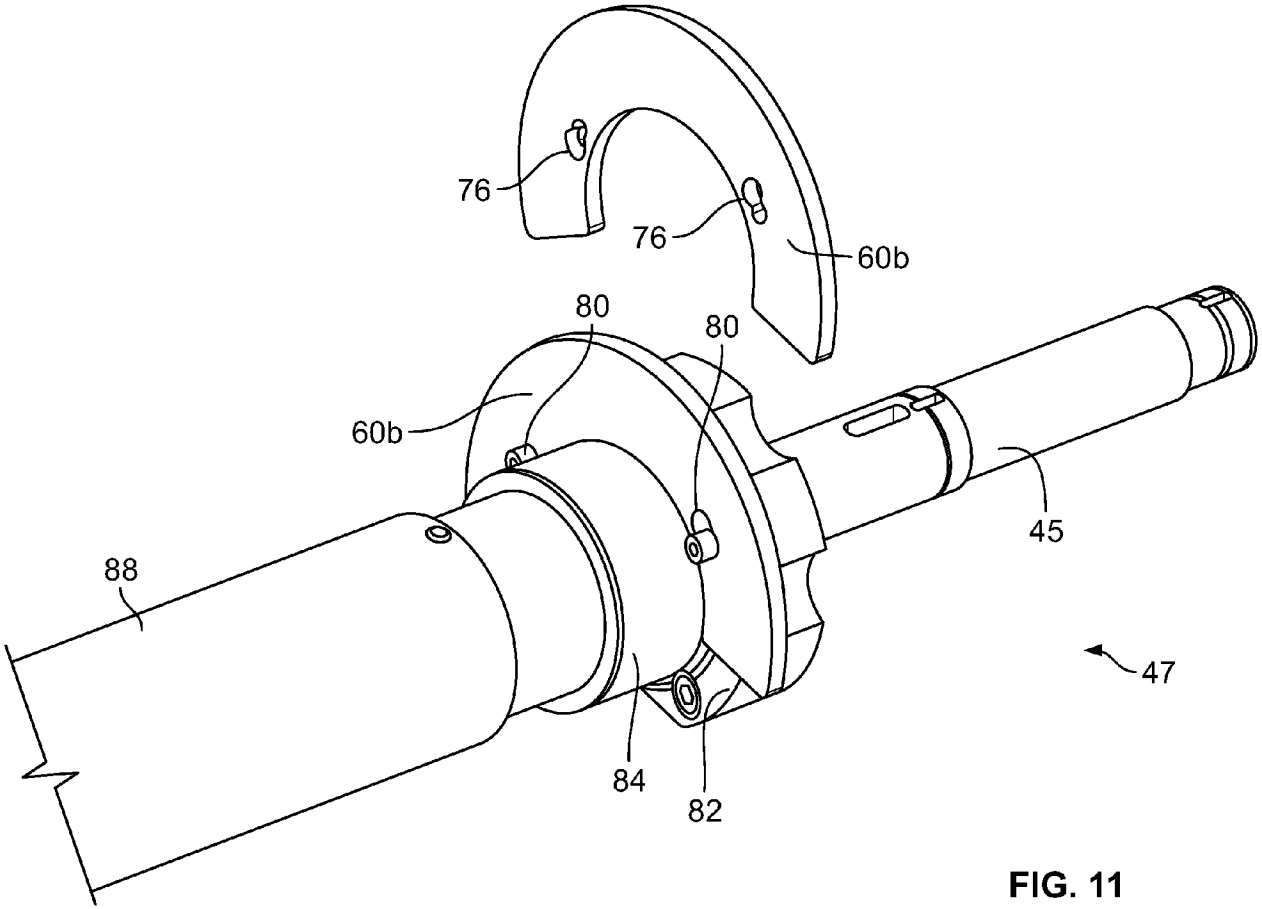
FIG. 11 shows an embodiment of how a plate cylinder support may interchangeably support at least two plate cylinder cams.

FIG. 11 shows how plate cylinder support 47 may interchangeably support at least two plate cylinder cams, e.g. plate cylinder cams 60*a*, 60*b*, 60*c*. In this embodiment, plate cylinder support 47 includes shaft 45, a mandrel 88 for receiving plate cylinders of varying sizes in sleeve form and a plate cylinder bearing housing 82 connecting mandrel 88 and shaft 45. As similarly discussed above, plate cylinder cams 60*a*, 60*b*, 60*c* are removably connectable to plate cylinder support 47 as alternatives of each other. In other words, only one of plate cylinder cams 60*a*, 60*b*, 60*c* is connected to plate cylinder support 47 depending on the desired cutoff of the variable cutoff printing unit. For example, for a print job requiring smaller plate cylinder 12*a*, plate cylinder cam 60*a* is removably secured to plate cylinder support 47, for a print job requiring middle plate cylinder 12*b*, plate cylinder cam 60*b* is removably secured to plate cylinder support 47 and for a print job requiring a print job requiring larger plate cylinder 12*c*, plate cylinder cam 60*c* is removably secured to plate cylinder support 47. Thus, to change from smaller plate cylinder 12*a* to large plate cylinder 12*c*, plate cylinder cam 60*a* interchanged with plate cylinder cam 60*c* by disconnecting and removing plate cylinder cam 60*a* from plate cylinder support 47 and mounting on plate cylinder cam 60*c* on plate cylinder support 47 and connecting plate cylinder cam 60*c* to plate cylinder support 47. As shown in FIG. 11, for example, plate cylinder cam 60*b* may be interchangeably removably connected to plate cylinder support 47 according to one embodiment of the present invention. Plate cylinder cam 60*b*, which is shown in FIG. 11 both before and after plate cylinder cam 60*b* is mounted on plate cylinder support 47, includes keyhole slots 76 formed therein for interaction with correspondingly configured connectors 80 on plate cylinder bearing housing 82 coupled to plate cylinder shaft 45. A radial edge of plate cylinder cam 60*b* axially abuts a radially protruding portion of plate cylinder bearing housing 82 and an inner circumference of plate cylinder cam 60*b* is flush with a pilot portion 84 of plate cylinder bearing housing 82. In this embodiment, an effective outer diameter and outer circumference of each plate cylinder cam 60*a*, 60*b*, 60*c* corresponds to the outer diameter and outer circumference of the respective plate cylinder 12*a*, 12*b*, 12*c* and an inner circumference and an inner diameter of each plate cylinder cam 60*a*, 60*b*, 60*c* corresponds to an outer diameter and outer circumference of pilot portion 84. In other embodiments, plate cylinder cams may be supported on plate cylinder shaft 45 in a manner that a surface supporting plate cylinder cams does not rotate.

The embodiment described above with respect to FIGS. 1 to 11 allows form roll F to be positioned against at least two different sized plate cylinders in the variable cutoff printing presses. Although only three different sized plate cylinders 12*a*, 12*b*, 12*c* and corresponding plate cylinder cams 60*a*, 60*b*, 60*c* are described above for use with printing unit 10, any number of different sized plate cylinders and corresponding plate cylinder cams may be used in printing unit 10, with plate cylinder support 47 being configured for interchangeably removably supporting the different sized plate cylinders and corresponding plate cylinder cams as alternatives of each other. For example, form roll adjusting apparatus 100 may adjustably position form roll F against two different sized plate cylinders to print two different print jobs of two different cutoffs one after another. For the first print job of the first cutoff, a first sized plate cylinder, e.g., plate cylinder 12*b*, having a first diameter, and a first sized plate cylinder cam, e.g., plate cylinder cam 60*b*, having a first effective diameter equal to the first diameter, are placed on plate cylinder support 47. As discussed above, plate cylinder cam 60*b* is placed on plate cylinder support 47 by bringing the inner circumference of plate cylinder cam 60*b* into contact with pilot portion 84 of plate cylinder bearing housing 82 and removably connecting plate cylinder cam 60*b* to plate cylinder support 47 by engaging holes keyhole slots 76 in plate cylinder cam 60*b* with connectors 80 on plate cylinder bearing housing 82. Actuator 56 may then move hanger 40 along the predefined path defined by guide 72 such that guide portion 68 of hanger 40 enters into position 68*b* of the predefined path in slot 70 and hanger 40, via contact surface 162 of cam follower 62, contacts plate cylinder cam 60*b*, causing form roll F to enter into a loaded position with plate cylinder 12*b*. In the loaded position, form roll F is either in contact with plate cylinder 12*b* or is spaced away from plate cylinder 12*b* such a small distance that adjustment by adjustor 64 bring form roll F into contact with plate cylinder 12*b*. Adjustment assembly 58 may be adjusted before or after form roll F is loaded onto plate cylinder 12*b* by moving adjustor 64 to vary the position of cam follower 62 and set the squeeze between form roll F and plate cylinder 12*b* at a desired amount. The first print job of the first cutoff length may then be printed by printing unit 10.

After the first print job is printed, actuator 56 may move hanger 40 along guide 72 such that form roll F is moved away from plate cylinder 12*b* and contact surface 162 is moved away from plate cylinder cam 60*b* so that plate cylinder cam 60*b* and plate cylinder 12*b* may be interchanged with another plate cylinder cam, e.g., plate cylinder cam 60*a* or 60*c*, and another plate cylinder, e.g., plate cylinder 12*a* or 12*c*. Then, plate cylinder cam 60*b* may be removed from plate cylinder support 57 by disengaging slots 76 from connectors 80 and sliding plate cylinder cam 60*b* off of pilot portion 84 and plate cylinder 12*b* may be removed from plate cylinder support 47. For the second print job of the second cutoff, a second sized plate cylinder, e.g., plate cylinder 12*a* or 12*c*, having a second diameter different from the first diameter, and a second sized plate cylinder cam, e.g., plate cylinder cam 60*a* or 60*c*, having a second effective diameter equal to the second diameter, are placed on plate cylinder support 47. As similar to plate cylinder cam 60*b* discussed above, plate cylinder cam 60*a* or 60*c* is placed on plate cylinder support 47 by bringing the inner circumference of plate cylinder cam 60*a* or 60*c* into contact with pilot portion 84 of plate cylinder bearing housing 82 and removably connecting plate cylinder cam 60*a* or 60*c* to plate cylinder support 47 by engaging holes keyhole slots 76 in plate cylinder cam 60*a* or 60*c* with connectors 80 on plate cylinder bearing housing 82. Actuator 56 may then move hanger 40 along the predefined path defined by guide 72 such that guide portion 68 of hanger 40 enters into either position 68*a* or 68*c* of the predefined path in slot 70 and hanger 40, via contact surface 162 of cam follower 62, contacts plate cylinder cam 60*b*, causing form roll F to enter into a loaded position with plate cylinder 12*b*. In the loaded position, form roll F is in contact with plate cylinder 12*a* or 12*c*. The second print job of the second cutoff length may then be printed by printing unit 10.

In the example described above, form roll hanger 40 is configured for contacting at least the three exemplary different sized plate cylinder cams 60*a*, 60*b*, 60*c* to set different distances between plate cylinder axis $CL_P$ and form roll axis $CL_F$. If the smaller plate cylinder cam 60*a* is coupled to the plate cylinder support 47, form roll hanger 40 sets a smaller distance between plate cylinder axis $CL_P$ and form roll axis $CL_F$. If the larger plate cylinder cam 60*c* is coupled to the plate cylinder support 47, form roll hanger 40 sets a larger distance between plate cylinder axis $CL_P$ and form roll axis $CL_F$. If the middle plate cylinder cam 60*b* is coupled to the plate cylinder support 47, form roll hanger 40 sets a middle distance, i.e., a distance larger than the smaller distance and smaller than the larger distance, between plate cylinder axis $CL_P$ and form roll axis $CL_F$. As a result, form roll hanger 40 allows printing unit 10 to be used to print using at least the three exemplary different sized plate cylinders 12*a*, 12*b*, 12*c* to print the at least three different exemplary cutoff lengths.

Figure 12:
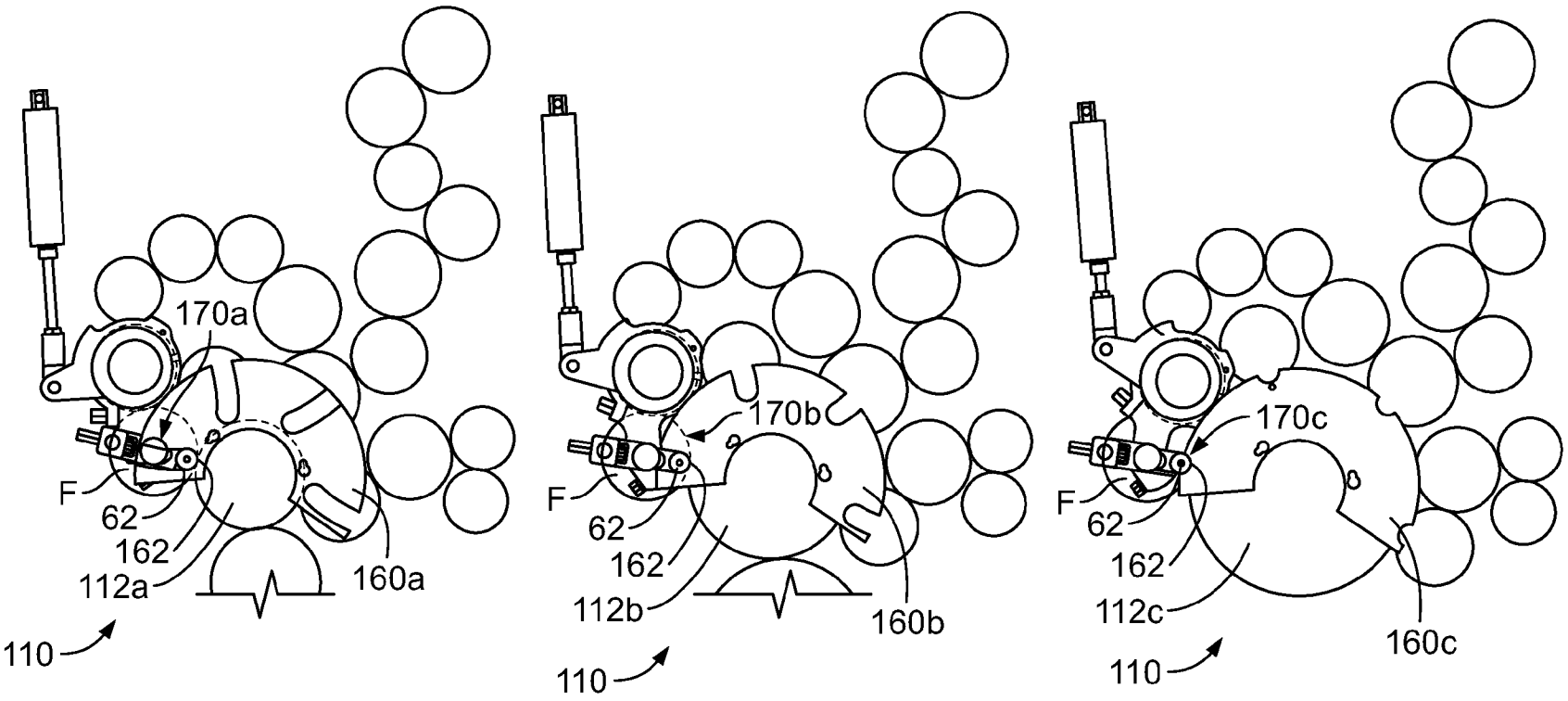
FIG. 12 shows three views of a printing unit according to another embodiment of the present invention for three different sized plate cylinder cams.

FIG. 12 shows three views of a printing unit 110 according to another embodiment of the present invention, each showing printing unit 110 configured for a different sized plate cylinder cam 160*a*, 160*b*, 160*c*. As is shown, guide 72 (FIGS. 4 to 8) has been omitted and plate cylinder cams 160*a*, 160*b*, 160*c* themselves include guides in the form of guide slots 170*a*, 170*b*, 170*c*, respectively, for receiving cam followers 62. In this embodiment, guides 170*a*, 170*b*, 170*c* are configured to define the predefined path of form roll hanger 240 that allows form roll F to maintain appropriate contact with vibrator roll V and the corresponding plate cylinder. Other than this difference, form roll hanger 140 may be formed in the same manner as form roll hanger 40 shown in FIGS. 2 to 11. In contrast to plate cylinder cams 60*a*, 60*b*, 60*c* shown in FIGS. 6 to 8, outer diameters of cams 160*a*, 160*b*, 160*c* are greater than the outer diameters of corresponding plate cylinders 112*a*, 112*b*, 112*c*, respectively. However, guide slots 170*a*, 170*b*, 170*c* are configured to guide and stop the movement of cam followers 62 along the outer diameter of plate cylinders, respectively, such that a proper squeeze between form roll F and plate cylinders 112*a*, 112*b*, 112*c* is attained. As shown in FIG. 12, each of cams 160*a*, 160*b*, 160*c* may include a plurality of respective guide slots 170*a*, 170*b*, 170*c*, which can be used with respective other form roll hanger assemblies 140 to position additional form rolls F.

Figure 13:
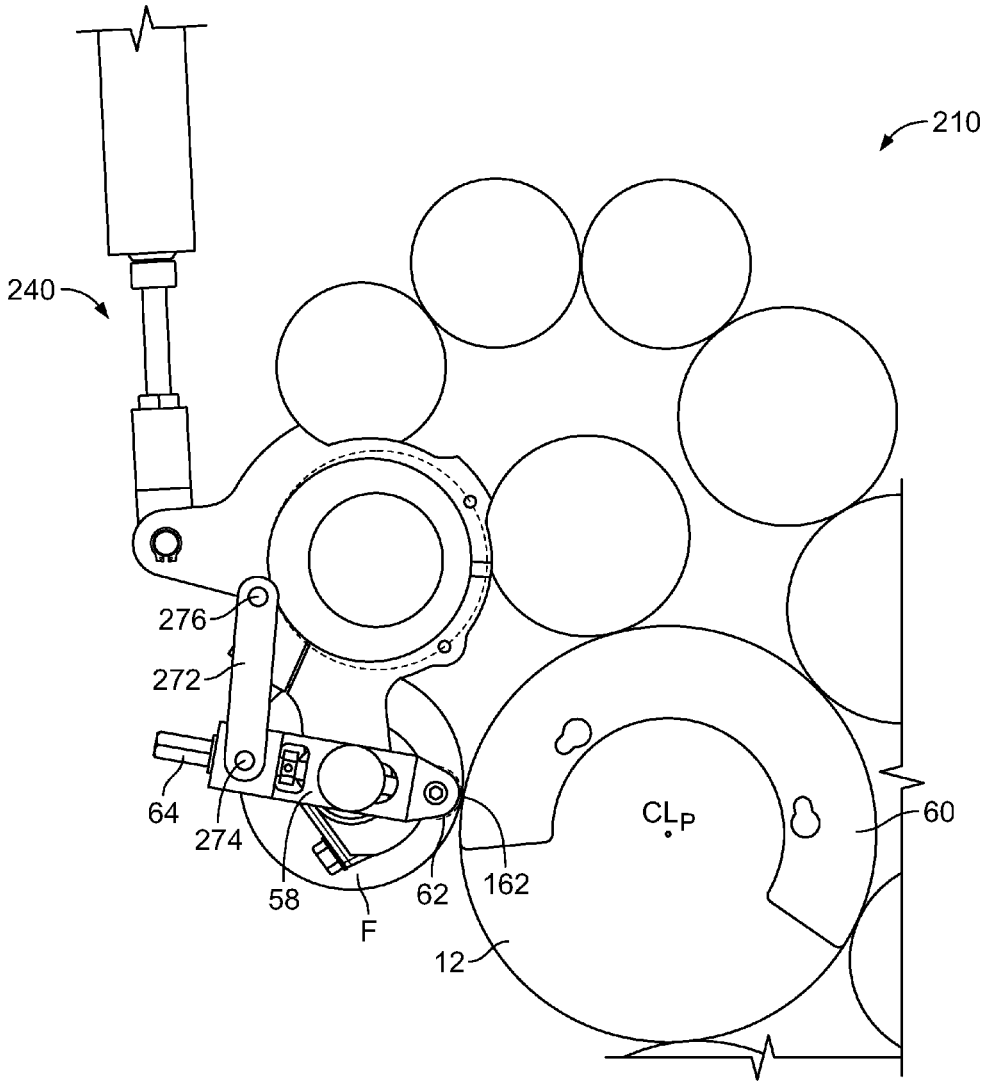
FIG. 13 shows three views of a printing unit according to another embodiment of the present invention for three different sized plate cylinder cams.

FIG. 13 shows a printing unit 210 according to another embodiment of the present invention including a form roll hanger 240. As is shown, guide 72 (FIGS. 4 to 8) has been replaced with a guide 272, e.g., a link, that is rotatably connected to adjustment assembly 58 by a first pivot 274 and is rotatably fixed to a frame of printing unit 210 by a second pivot 276. In this embodiment, guide 272 is configured to define the predefined path of form roll hanger 240 that allows form roll F to maintain appropriate contact with vibrator roll V and a plurality of sized plate cylinders. Other than this difference, form roll hanger 240 may be formed in the same manner as form roll hanger 40 shown in FIGS. 2 to 11. Adjustment assembly 58 is adjustable by using adjustor 64 to move cam follower 62 toward and away from center axis $CL_P$ of plate cylinder 12 to contact plate cylinder cam 60 and set a proper squeeze between form roll F and plate cylinder 12.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. An apparatus for adjustably positioning a form roll against at least two different sized plate cylinders in a variable cutoff printing unit, the form roll having a form roll axis, the apparatus comprising:

a plate cylinder support for interchangeably supporting the at least two different sized plate cylinders, the plate cylinder support including a plate cylinder bearing housing and a plate cylinder axis, the plate cylinder axis defining a centerline of the plate cylinder, wherein the centerline does not change position, except that the centerline may change position for plate skew or throw-off;

said plate cylinder bearing housing capable of interchangeably supporting at least two different sized plate cylinder cams, the at least two different sized plate cylinder cams including a smaller plate cylinder cam and a larger plate cylinder cam that are removably connectable to the plate cylinder support as alternatives of each other; and a form roll hanger for supporting the form roll, the form roll hanger being configured for contacting the smaller plate cylinder cam if the smaller plate cylinder cam is coupled to the plate cylinder support to set a smaller distance between the plate cylinder axis and the form roll axis, the form roll hanger being configured for contacting the larger plate cylinder cam if the larger plate cylinder cam is coupled to the plate cylinder support to set a larger distance between the plate cylinder axis and the form roll axis.

2. The apparatus as recited in claim 1 wherein the form roll hanger includes a contact surface for contacting the one of the at least two different sized plate cylinder cams that is supported on the plate cylinder support, the form roll hanger being movable along a predefined path to vary a distance between the plate cylinder axis and the form roll axis.

3. The apparatus as recited in claim 2 further comprising a guide defining the predefined path, the guide controlling movement of the form roll hanger as the contact surface is moved toward and away from the plate cylinder axis.

4. The apparatus as recited in claim 3 wherein the guide is configured such that the predefined path followed by the form roll hanger causes the form roll hanger to be slideable into positions for the contact surface to contact each of the at least two different sized plate cylinder cams as the at least two different sized plate cylinder cams are alternately connected to the plate cylinder support.

5. The apparatus as recited in claim 1 further comprising a vibrator roll, the form roll hanger including a bearing for rotatably supporting the vibrator roll.

6. The apparatus as recited in claim 5 wherein the form roll hanger further includes an eccentric, the eccentric being configured so as to maintain predefined contact pressure between the vibrator roll and the form roll as the form roll axis is moved toward and away from the plate cylinder axis.

7. A variable cutoff printing unit comprising:

the assembly for adjustably positioning a form roll against at least two different sized plate cylinders as recited in claim 1;

the at least two different sized plate cylinders, the at least two different sized plate cylinders including a smaller plate cylinder and a larger plate cylinder that are removably connectable to the plate cylinder support as alternatives of each other; and the form roll, the form roll hanger supporting the form roll;

the form roll hanger being configured such that the smaller plate cylinder contacts the form roll when the smaller plate cylinder and the smaller plate cylinder cam are connected to the plate cylinder support and the smaller plate cylinder cam contacts the form roll hanger, the form roll hanger being configured such that larger plate cylinder contacts the form roll when the larger plate cylinder and the larger plate cylinder cam are connected to the plate cylinder support and the larger plate cylinder cam contacts the form roll hanger.

8. The variable cutoff printing press as recited in claim 7 wherein the form roll hanger includes a contact surface for contacting the one of the at least two different sized plate cylinder cams that is supported on the plate cylinder support, the form roll hanger a predefined path.

9. The variable cutoff printing press as recited in claim 8 wherein the predefined path includes a first position and a second position, the contact surface being at an outer diameter of the smaller plate cylinder cam when a guide portion of the form roll hanger is at the first position, the contact surface being at an outer diameter of the larger plate cylinder cam when the guide portion of the form roll hanger is at the second position.

10. The variable cutoff printing press as recited in claim 9 wherein an outer surface of the form roll is at an outer surface of the smaller plate cylinder when the guide portion of the form roll hanger is at the first position, the outer surface of the form roll being at an outer diameter of the larger plate cylinder when the guide portion of the form roll hanger is at the second position.

11. The variable cutoff printing press as recited in claim 8 wherein the defined path includes a plurality of predefined positions, a contact surface of the form roll hanger being at an outer diameter of one of the at least two different sized plate cylinders when the guide portion of the form roll hanger is at each of the predefined positions.

12. The apparatus as recited in claim 1 further comprising a linear actuator, the linear actuator controlling movement of the form roll hanger as the contact surface is moved toward and away from the plate cylinder axis.

* * * * *